US005911359A

United States Patent [19]

Stone et al.

[11] Patent Number: 5,911,359

[45] Date of Patent: Jun. 15, 1999

[54] FLIP-TOP CARTON WITH INTEGRAL PARTIAL COLLAR

[75] Inventors: James L. Stone, Grand Rapids; David F. Gnadt, Grandville; Thomas J. Brink, Kentwood, all of Mich.

[73] Assignee: Tenneco Packaging Inc., Lake Forest, Ill.

[21] Appl. No.: 08/992,624

[22] Filed: Dec. 17, 1997

[51] Int. Cl.[6] ..... B65D 5/72

[52] U.S. Cl. ..... 229/219; 229/234; 229/160.1; 229/145; 206/273

[58] Field of Search ..... 229/231, 219, 229/234, 160.1, 145; 206/273

[56] References Cited

U.S. PATENT DOCUMENTS

| | | | |
|---|---|---|---|
| Re. 26,471 | 10/1968 | Meyers . | |
| 1,998,717 | 4/1935 | Guyer | 229/160.1 X |
| 2,348,377 | 5/1944 | Goodyear . | |
| 2,367,476 | 1/1945 | Tryseck et al. . | |
| 2,369,387 | 2/1945 | Williamson et al. . | |
| 2,369,392 | 2/1945 | Ringler . | |
| 2,396,310 | 3/1946 | Yungblut . | |
| 2,403,698 | 7/1946 | Williamson et al. . | |
| 2,502,117 | 3/1950 | Anderson . | |
| 2,717,074 | 9/1955 | Williamson et al. . | |
| 2,836,343 | 5/1958 | Will . | |
| 2,848,153 | 8/1958 | Geiger, Sr. | 229/160.1 |
| 2,881,967 | 4/1959 | Ringler | 229/231 |
| 2,951,627 | 9/1960 | Wenzel . | |
| 2,983,424 | 5/1961 | Glass | 229/160.1 X |
| 3,140,809 | 7/1964 | Hickin et al. . | |
| 3,207,416 | 9/1965 | Koltz et al. . | |
| 3,345,918 | 10/1967 | Simeone . | |
| 3,355,995 | 12/1967 | Borkmann et al. . | |
| 3,432,090 | 3/1969 | Engel . | |
| 3,524,581 | 8/1970 | Buttery . | |
| 3,708,108 | 1/1973 | Rosenberg, Jr. . | |
| 3,756,501 | 9/1973 | Skillen et al. . | |
| 3,910,486 | 10/1975 | Stone . | |
| 3,963,173 | 6/1976 | Stone . | |
| 4,048,052 | 9/1977 | Tolaas . | |
| 4,083,455 | 4/1978 | Keating, Jr. . | |
| 4,102,457 | 7/1978 | Meyers . | |
| 4,127,229 | 11/1978 | Roccaforte . | |
| 4,141,449 | 2/1979 | Stone . | |
| 4,284,193 | 8/1981 | Roccaforte . | |

(List continued on next page.)

FOREIGN PATENT DOCUMENTS

| | | |
|---|---|---|
| 1017728 | 9/1977 | Canada . |
| 1323608 | 10/1993 | Canada . |
| 2229996 | 10/1990 | United Kingdom . |

*Primary Examiner*—Gary E. Elkins
*Assistant Examiner*—Tri M. Mai
*Attorney, Agent, or Firm*—Arnold, White & Durkee

[57] ABSTRACT

A one-piece, flip-top reclosable container embodying the present invention includes an outer carton having opposing top and bottom walls, front and back walls, and first and second side walls. The first and second side walls and the front wall include a preferential area of weakness for opening the carton from a sealed form to an unsealed form. The preferential area of weakness forms a lid hingedly connected to the top wall. The top wall includes a front top minor flap hingedly connected to an upper end of the front wall. An internal collar is integrally formed with the front top minor flap. The internal collar is disposed within the carton when the carton is in the sealed form. The internal collar includes a front panel and opposing first and second side panels adjacent to the respective front wall and the opposing first and second side walls of the carton. The front panel of the internal collar is detachably connected to the front top minor flap along at least one horizontal fold line. The internal collar optionally includes an extension flap comprised of at least one hinged portion and at least one island portion disposed in forcibly displaceable mutual engagement such that opening the lid exerts a force which disengages the mutual engagement and closing the lid leads to snap re-engagement of the hinged portion and the island portion.

37 Claims, 8 Drawing Sheets

U.S. PATENT DOCUMENTS

| | | | |
|---|---|---|---|
| 4,289,239 | 9/1981 | Meyers . | |
| 4,314,643 | 2/1982 | Forbes, Jr. . | |
| 4,531,669 | 7/1985 | Osborne . | |
| 4,542,847 | 9/1985 | Lindstrom . | |
| 4,551,125 | 11/1985 | Pezzana et al. . | |
| 4,679,694 | 7/1987 | Donohie et al. . | |
| 4,688,677 | 8/1987 | Roccaforte . | |
| 4,726,471 | 2/1988 | Whately et al. . | |
| 4,732,315 | 3/1988 | Gunn . | |
| 4,768,703 | 9/1988 | Sosler et al. . | |
| 4,773,542 | 9/1988 | Schillinger et al. . | |
| 4,913,693 | 4/1990 | Ball et al. . | |
| 4,948,038 | 8/1990 | Moeller . | |
| 4,987,420 | 1/1991 | Gunn et al. . | |
| 5,092,516 | 3/1992 | Kastanek . | |
| 5,129,875 | 7/1992 | Chaygneaud-Dupuy . | |
| 5,148,973 | 9/1992 | Zimmermann . | |
| 5,154,343 | 10/1992 | Stone . | |
| 5,161,734 | 11/1992 | Ruehl et al. . | |
| 5,209,394 | 5/1993 | Griffiths et al. . | |
| 5,215,248 | 6/1993 | Moser . | |
| 5,219,089 | 6/1993 | Kiolbasa et al. . | |
| 5,236,123 | 8/1993 | Stone et al. . | |
| 5,238,179 | 8/1993 | Hart . | |
| 5,265,799 | 11/1993 | Stone . | |
| 5,277,360 | 1/1994 | DeMott . | |
| 5,299,732 | 4/1994 | Armor et al. . | |
| 5,314,114 | 5/1994 | Stone . | |
| 5,320,279 | 6/1994 | Giblin et al. . | |
| 5,322,215 | 6/1994 | Roccaforte . | |
| 5,328,091 | 7/1994 | Koss . | |
| 5,373,960 | 12/1994 | Gunn et al. . | |
| 5,439,133 | 8/1995 | Stone . | |
| 5,505,374 | 4/1996 | Stone . | |
| 5,515,996 | 5/1996 | Stone . | |
| 5,551,938 | 9/1996 | Stone . | |
| 5,553,773 | 9/1996 | Focke et al. | 206/273 X |
| 5,673,849 | 10/1997 | Stone . | |
| 5,749,462 | 5/1998 | Houghton | 206/273 X |

FLIP-TOP CARTON WITH INTEGRAL PARTIAL COLLAR

FIELD OF THE INVENTION

The present invention relates generally to flip-top reclosable paperboard containers and, more particularly, relates to a flip-top reclosable container having an internal partial collar integrally formed with the front top minor flap of the container.

BACKGROUND OF THE INVENTION

One type of flip-top reclosable container is a two-piece structure having an outer carton and a separately formed internal collar or liner. The outer carton generally includes opposing top and bottom walls, opposing front and back walls, and opposing first and second side walls. The first and second side walls and the front wall include a continuous horizontal tear strip for opening up the carton from a sealed form to form a lid hingedly connected to a base. The separately formed collar is located within the outer carton. The collar includes a front panel and opposing first and second side panels which are adhered to the respective front wall and opposing first and second side walls of the outer carton. To open the carton, the tear strip is removed and the lid is lifted upward relative to the base. To reclose the carton, the lid is pushed back downward to its original position, where the lid is retained either by frictional engagement with the base or by some type of snap closure feature.

Although two-piece containers of the foregoing type can provide excellent functionality if properly manufactured, such two-piece containers generally require more paperboard than one-piece containers. The use of additional paperboard in the two-piece containers increases the cost of manufacturing such containers.

Furthermore, the two-piece containers generally require a high degree of precision during the manufacturing process. To manufacture the two-piece container, the outer carton is formed from a carton blank and the internal collar is formed from a separate collar blank. To form the reclosable container from the carton and collar blanks, the collar blank is glued to the inner surface of the carton blank with the fold lines of the collar blank preferably aligned with corresponding fold lines of the carton blank. The joined carton and collar blanks are then folded in tandem with each other to create the reclosable container. In the above manufacturing process, the joined carton and collar blanks must be properly aligned to assure that the fold lines joining the walls of the outer carton will not crack in response to folding the joined carton and collar blanks in tandem with each other. Moreover, if the container is provided with a snap closure feature for retaining the lid in the closed position, proper alignment of the outer carton and the internal collar assures that the closure feature will function properly.

Because of these deficiencies, one-piece containers with integral internal collars have been created. One known one-piece container connects the internal collar with the carton of the container by non-adjacent flaps each having an extension flap. The known one-piece containers are useful in applications where the entire top of the box is to be opened, such as boxes for storing granular detergent. However, the known one-piece containers are not made to have a top that only partially opens to form a spout with the side walls, as would be desirable in cereal boxes.

Accordingly, a need exists for a flip-top reclosable container that overcomes the above-noted shortcomings generally associated with existing containers. Moreover, a need exists for producing a one-piece container with an integral partial collar which is connected to as few as one of the top flaps so as to provide a carton top that only partially opens. The present invention effectively and conveniently realizes such a reclosable container.

SUMMARY OF THE INVENTION

A one-piece, flip-top reclosable container embodying the present invention includes an outer carton having opposing top and bottom walls, front and back walls, and first and second side walls. The first and second side walls and the front wall include a preferential area of weakness for opening the carton from a sealed form to an unsealed form. The preferential area of weakness forms a lid hingedly connected to the top wall. The top wall includes a front top minor flap hingedly connected to an upper end of the front wall. An internal collar is integrally formed with the front top minor flap. The internal collar is disposed within the carton when the carton is in the sealed form. The internal collar includes a front panel and opposing first and second side panels adjacent to the respective front wall and the opposing first and second side walls of the carton. The front panel of the internal collar is hingedly connected to the front top minor flap along at least one horizontal fold line. The internal collar optionally includes an extension flap comprised of at least one hinged portion and at least one island portion disposed in forcibly displaceable mutual engagement such that opening the lid exerts a force which disengages the mutual engagement and closing the lid leads to snap re-engagement of the hinged portion and the island portion.

The flip-top reclosable container described above is formed from a unitary, continuous blank. The blank includes a carton-forming portion and a collar-forming portion. The carton-forming portion includes a plurality of carton walls hingedly connected to each other along vertical fold lines. The carton-forming portion also includes a plurality of top and bottom closure flaps hingedly connected to respective upper and lower ends of the carton walls. The foregoing carton walls and closure flaps of the blank are used to form the outer carton of the reclosable container. The collar-forming portion includes a plurality of internal collar panels hingedly connected to each other along vertical fold lines. The internal collar panels of the blank are used to form the internal collar of the reclosable container. A front panel of the internal collar is hingedly connected to the front top minor flap along at least one horizontal fold line. The collar-forming portion may include the hinged portion and the island portion described above in connection with the reclosable container.

The one-piece, flip-top reclosable container embodying the present invention is advantageous because it can be produced from less paperboard than typical two-piece, flip-top reclosable cartons. Even though the collar-forming portion of the blank protrudes outside of the generally rectangular outline of the carton-forming portion, the collar-forming portion of the blank is nested into the bottom of a carton-forming portion of an adjacent blank during the manufacturing process. Thus, the present blank configuration minimizes the amount of paperboard used, thereby reducing the manufacturing costs of the container while saving paperboard.

In addition, since the internal collar is integrally formed with the outer carton, these two elements will be properly aligned with each other. This proper alignment assures that the fold lines joining the walls of the carton will not crack in response to forming the blank into the reclosable container. Moreover, if the container is provided with a snap closure feature for retaining the lid in the closed position, the proper alignment of the outer carton and the internal collar assures that the closure feature will function properly.

Additionally, the one-piece integral internal collar of the present invention allows for a container that has a top wall that only partially opens so as to form a spout with the front panel and the first and second side panels of said internal collar. This container design allows for the easy dispensing of the contents of the container after the top of the container has been opened. Moreover, the design of the present invention allows for several variations where the internal collar is attached to the carton of the container by as few as one flap, or two adjoining flaps. Where the internal collar is attached to only one flap, it is attached to the minor flap so as to provide a reinforced area for the spout described above.

BRIEF DESCRIPTION OF THE DRAWINGS

Other objects and advantages of the invention will become apparent upon reading the following detailed description and upon reference to the drawings in which.

Figure 1:
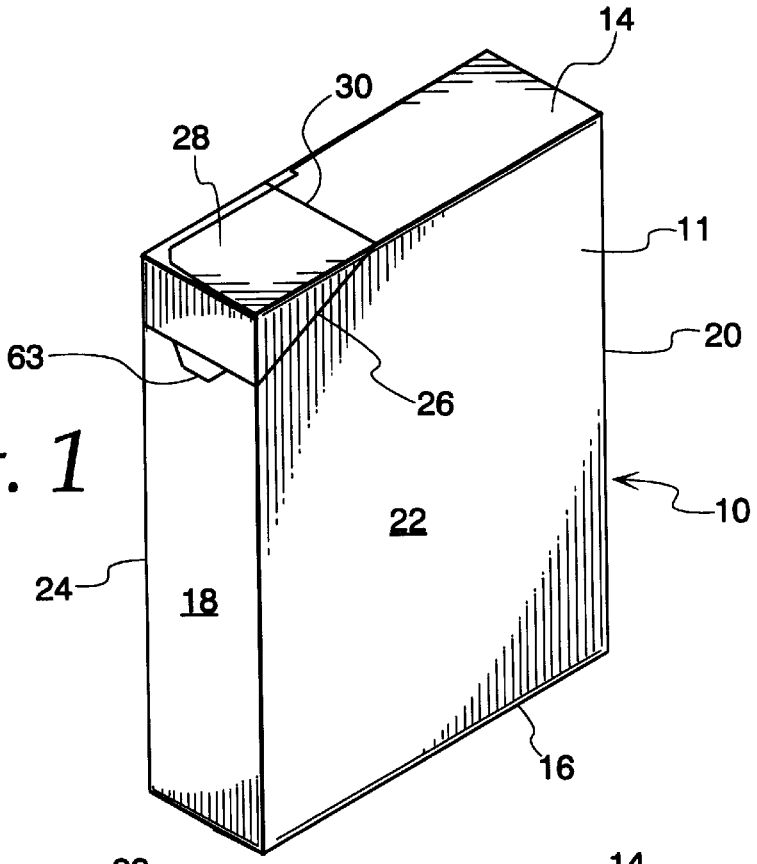
FIG. 1 is an isometric view of the container of the present invention in the closed position.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
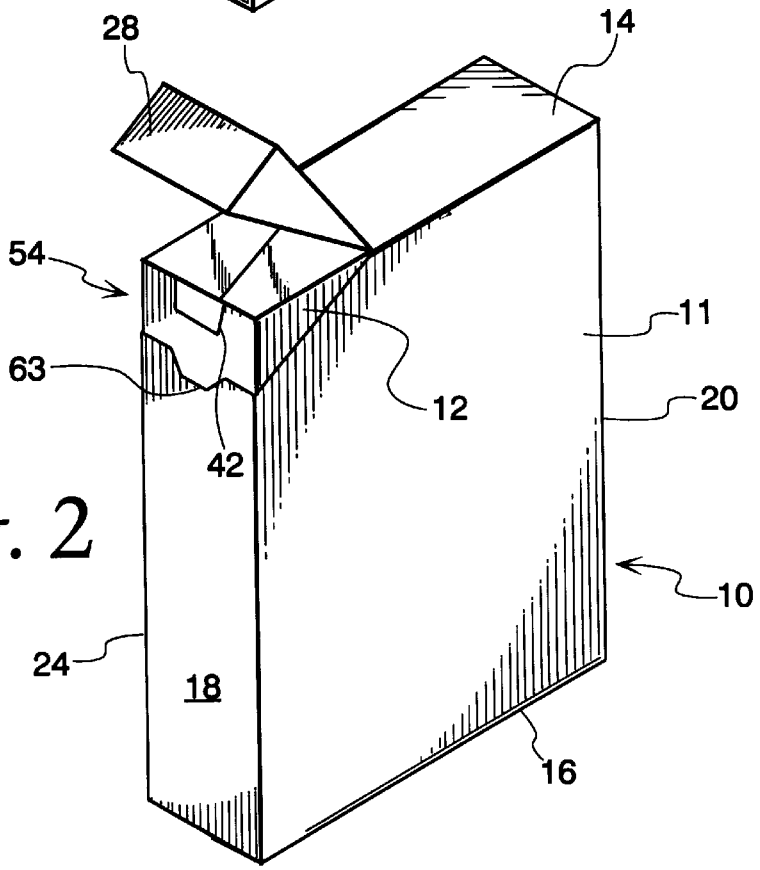
FIG. 2 is an isometric view of the container of the present invention in the opened position.

Turning now to the drawings, in which analogous items are designated by the same reference numerals, a flip-top reclosable container 10 is shown in its closed position in FIG. 1 and in its opened position in FIG. 2. A unitary, continuous blank composed of paperboard, cardboard, or the like, forms the one-piece, flip-top reclosable container 10. The container 10 is comprised of an outer carton 11 and an internal collar 12. The outer carton 11 includes opposing top and bottom walls 14 and 16, opposing front and back walls 18 and 20, and opposing first and second side walls 22 and 24. The first and second side walls 22 and 24 and the front wall 18 include a preferential area of weakness 26, such as a perforated line, a reverse cut, etc., for opening the carton 11, which forms a lid 28 hingedly connected to the top wall 14 along a hinge 30 that is spaced away from the back wall 20.

Figure 3A:
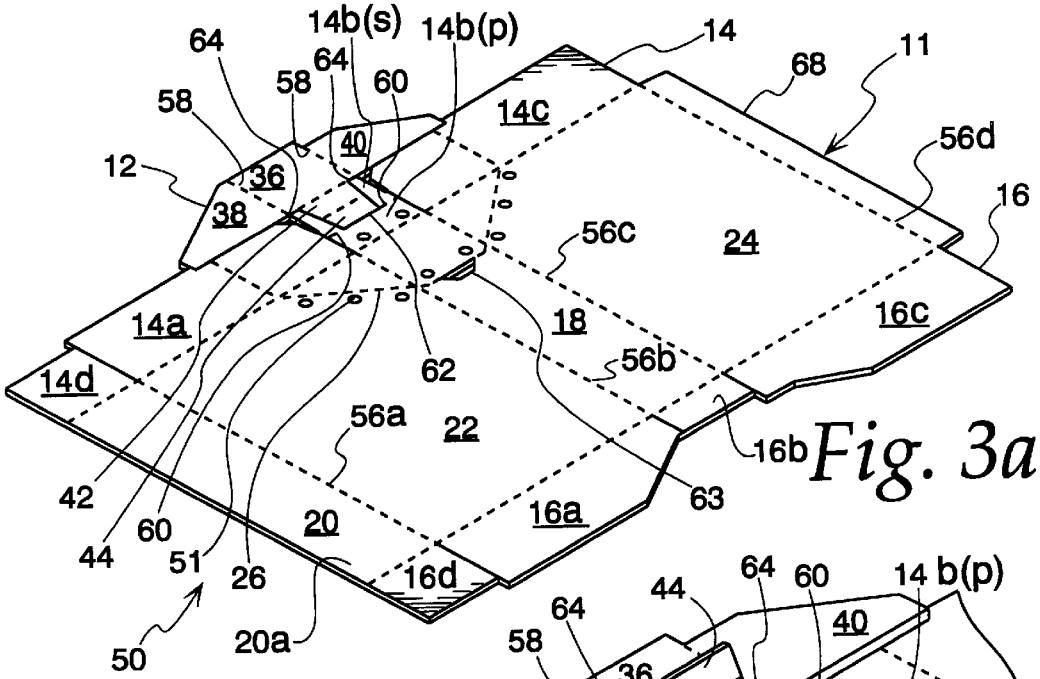
FIG. 3*a* is an isometric view of a first blank used to form the container of the present invention.
Figure 3B:
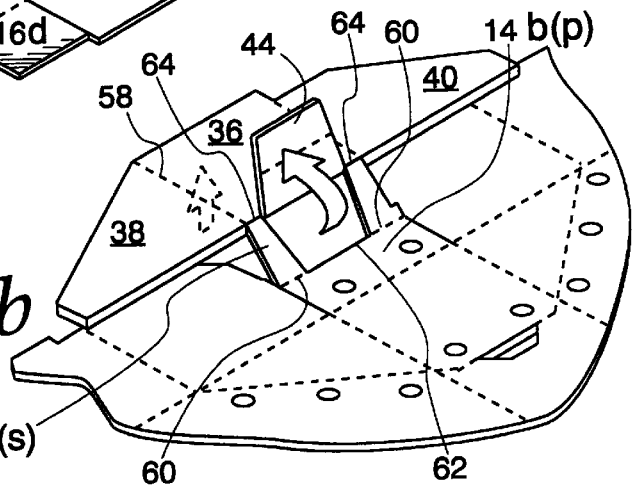
FIG. 3*b* is a partial isometric view of the first blank of FIG. 3*a* while a Z-type fold is being imparted to the blank.

Referring to FIG. 3, a blank 50 for forming the container 10 is illustrated. The blank 50 includes the top wall 14 which is partially comprised of a top minor flap 14*b* hingedly connected to the internal collar 12 along horizontal fold lines 64. The internal collar 12 is thus integrally formed, by a hinged connection, with the top minor flap 14*b* of the carton 11. Prior to initially opening the carton 11, the internal collar 12 is still hingedly connected to the top minor flap 14*b*. Opening the carton 11 breaks this hinged connection between the internal collar 12 and the top minor flap 14*b*. After the container 10 is formed, the internal collar 12 is disposed within the carton 11. The internal collar 12 includes a front panel 36 and opposing first and second side panels 38 and 40 which are adhered to the respective front wall 18 and the opposing first and second side walls 22 and 24. The internal collar 12 optionally includes an extension flap 62 for providing the container 10 with a snap closure feature. In the embodiment depicted in FIGS. 11–13, the snap closure feature is located along the front of the container 10.

Figure 11:
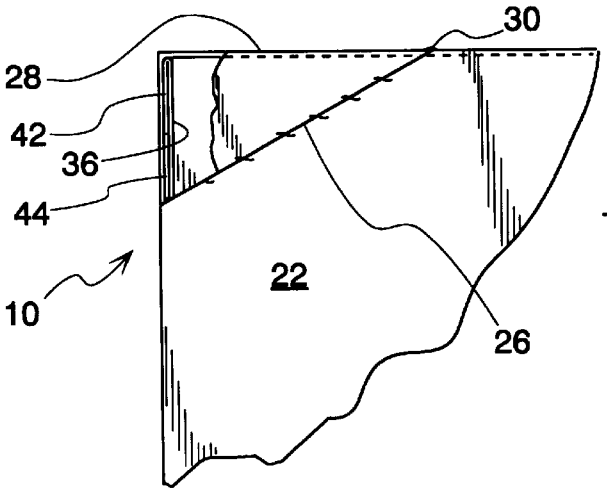
FIG. 11 is a partial breakaway side view of the closure feature of the present invention where the container is in the closed position.
Figure 12:
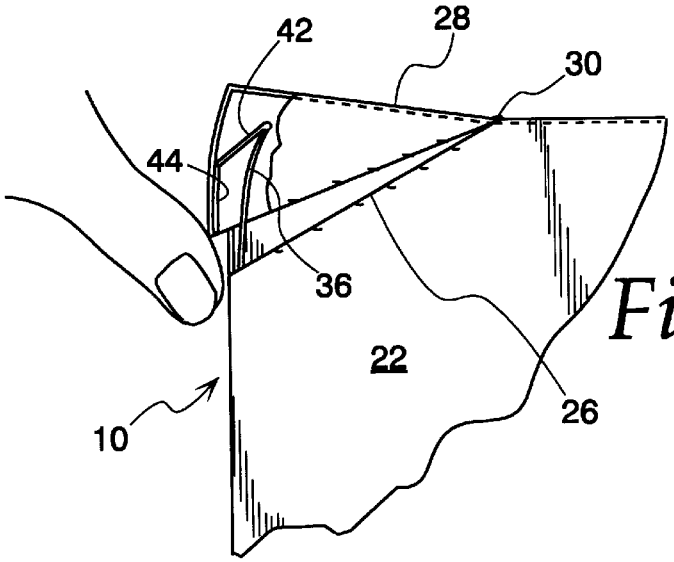
FIG. 12 is a partial breakaway side view of the closure feature of the present invention where the container is being opened.
Figure 13:
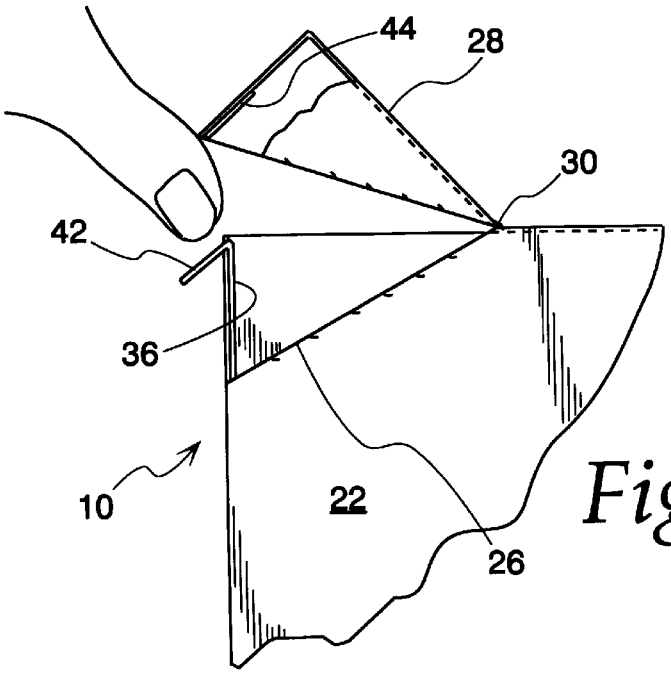
FIG. 13 is a partial breakaway side view of the closure feature of the present invention where the container is in the opened position.
Figure 14:
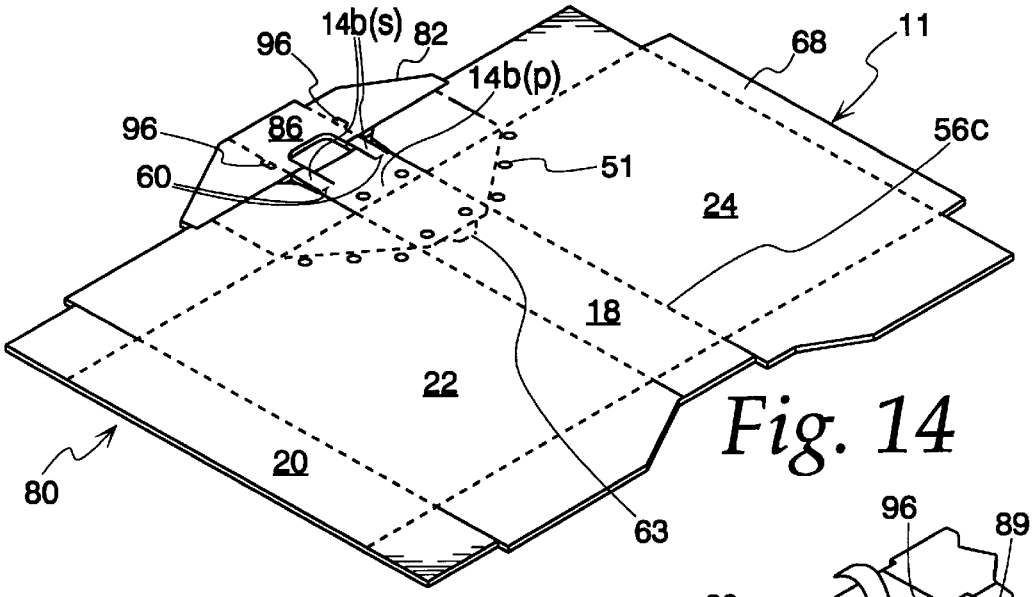
FIG. 14 is an isometric view of a second blank used to form the container of the present invention.

To create the front snap closure feature illustrated in FIGS. 11–13, the internal collar 12 includes the extension flap 62, which has a hinged portion 42 and an island portion 44. Prior to initially opening the lid 28, the island portion 44 is fixedly adhered to an inner surface of the lid 28 and is detachably linked to the hinged portion 42 by weakening nicks.

The construction of the hinged and island portions 42 and 44 of the extension flap 62 is most clearly shown in FIG. 3; the function of the hinged and island portions 42 and 44 is best shown in FIGS. 11–13. After the preferential area of weakness 26 is broken, opening the lid 28 exerts a force which disengages the mutual engagement of the hinged and island portions 42 and 44. Specifically, opening the lid 28 breaks the weakening nicks joining the island portion 44 to the hinged portion 42 and, therefore, separates the island portion 44 from the hinged portion 42. The island portion 44 is retained on the lid 28 because of the fixed attachment therebetween. Reclosing the lid 28 leads to snap re-engagement of the hinged portion 42 and the island portion 44.

Referring again to FIG. 3, the flip-top reclosable container 10 is formed from the blank 50. FIG. 3 shows an inner surface of the blank 50. The blank 50 includes a carton-forming portion 11 and a collar-forming portion 12. The carton-forming portion 11 is used to form the outer carton 11 shown in FIGS. 1 and 2, while the collar-forming portion 12 is used to form the internal collar 12.

The carton-forming portion 11 includes a plurality of carton walls 18, 20, 22, and 24 hingedly connected to each other along vertical fold lines 56*a–d*. The carton-forming portion 11 also includes a plurality of top and bottom closure flaps 14*a–d* and 16*a–d* hingedly connected to respective upper and lower ends of the carton walls 18, 20, 22, and 24. The foregoing carton walls and closure flaps of the blank 50 are used to form the outer carton 11 of the reclosable container 10.

The top closure flaps 14*a–d,* which form the top wall 14 of the container 10 in FIGS. 1 and 2, include the front and back minor flaps 14*b* and 14*d* and the first and second major flaps 14*a* and 14*c*. The front top minor flap 14*b* includes a primary portion 14*b*(p) and two secondary portions 14*b*(s). The primary portion 14*b*(p) is hingedly connected to the upper end of front wall 18, and the two secondary portions 14*b*(s) are in turn hingedly connected to the primary portion 14*b*(p). The top major flaps 14*a* and 14*c* are hingedly connected to the upper ends of the respective first and second side walls 22 and 24.

The bottom closure flaps 16*a–d,* which form the bottom wall 16 of the container 10 in FIGS. 1 and 2, include the first and second minor flaps 16*b* and 16*d* and the first and second major flaps 16*a* and 16*c*. The minor flaps 16*b* and 16*d* are hingedly connected to the lower ends of the respective front and back walls 18 and 20. The major flaps 16*a* and 16*c* are hingedly connected to the lower ends of the respective side walls 22 and 24.

The collar-forming portion 12 includes the internal collar panels 36, 38, and 40 that are hingedly connected to each other along vertical fold lines 58. The internal collar panels 36, 38, and 40 form the internal collar 12 of the reclosable container 10. The front panel 36 is hingedly connected to the front top minor flap 14*b* along horizontal fold lines 64. This hinged connection joining the front panel 36 to the front top minor flap 14*b* is temporary because, as stated above, the hinged connection is broken in response to inserting one's thumb into a thumb-hole 63 on the front wall 18 and initially opening the container 10 from a sealed form. The collar-forming portion 12 includes the extension flap 62 hingedly connected to the front panel 36. The extension flap 62 forms the hinged and island portions 42 and 44 described above.

FIGS. 4–10 depict the sequence of folding and gluing the blank 50 in FIG. 3 to form the reclosable container 10 in FIGS. 1 and 2. Adhesive applied to the blank 50 for purposes of attaching its folded portions is represented in FIGS. 4–10, as well as the figures associated with the other embodiments of the present invention, by generally circular glue dots and generally straight glue strips. Some of these glue dots and glue strips are designated by the reference numeral 51, as in FIG. 3.

Figure 4:
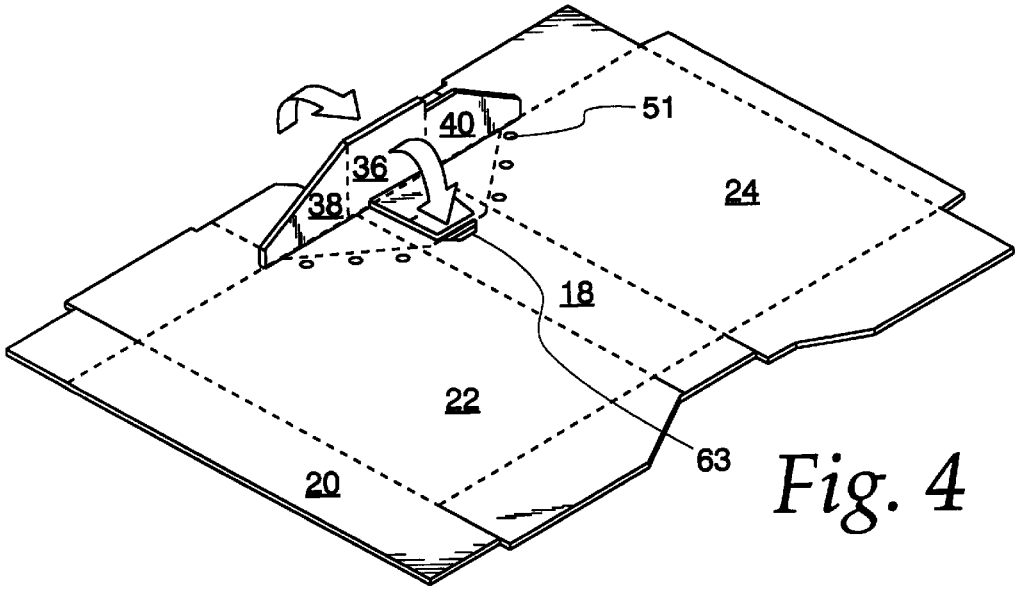
FIG. 4 is an isometric view of the first blank after a Z-type fold has been imparted to the blank.
Figure 5:
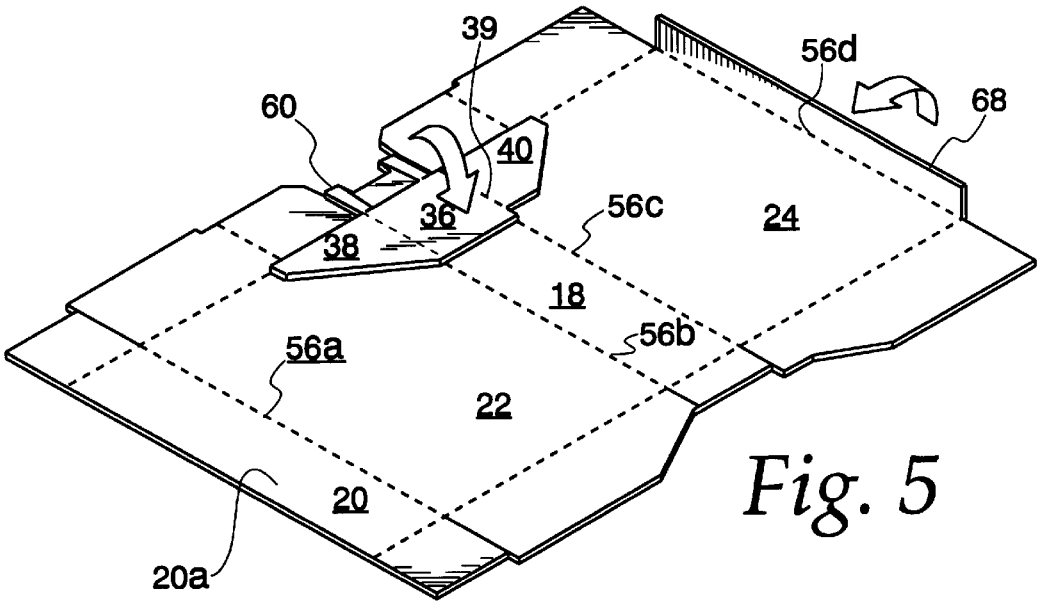
FIG. 5 is an isometric view of the first blank after the internal collar has been folded inward.

To realize the partially folded blank in FIG. 5 from the unfolded blank 50 in FIG. 3, a Z-type fold is imparted to the blank 50 in FIG. 3 along working fold lines 60 and 64. Specifically, the secondary minor flap portions 14*b*(s) are folded inward approximately 180 degrees relative to the primary minor flap portion 14*b*(p) along the working fold line 60, as shown in FIG. 4. Simultaneously, the front panel 36 and the side panels 38 and 40 are folded outward approximately 90 degrees relative to the secondary minor flap portions 14*b*(s) along the working fold lines 64, as shown in FIG. 4. As a result of the above fold, FIG. 5 illustrates that the inner surfaces of the secondary minor flap portions 14*b*(s) are adjacent to the inner surface of the primary minor flap portion 14*b*(p). The outer surfaces of the side panels 36, 38 and 40 are adjacent to the inner surfaces of the respective front wall 18, first side wall 22 and second side wall 24. The outer surface of the extension flap 62 is adjacent to the inner surface of the front wall 18 at a location above the preferential area of weakness 26. Furthermore, the inner surfaces of the secondary minor flap portions 14*b*(s) are then adhered to the inner surface of the primary minor flap portion 14*b*(p). Also, the outer surface of the island portion 44 of the extension flap 62 is adhered to the inner surface of the front wall 18 at a location above the preferential area of weakness 26. As a result of the above folds, the extension flap 62 is at a slight angle relative to the top of the thumb-hole 63. Specifically, fold line 39 is displaced over or to the right of fold line 56*c*. In this way, because cold glue is used, when the second side wall 24 is folded inward with respect to the front wall 18 (as described below), the collar-forming portion 12 is moved into proper alignment. Thus, the front panel 36 and the first and second side panels 38 and 40 are aligned with the front panel 18 and the first and second side panels 22 and 24, respectively.

Figure 6:
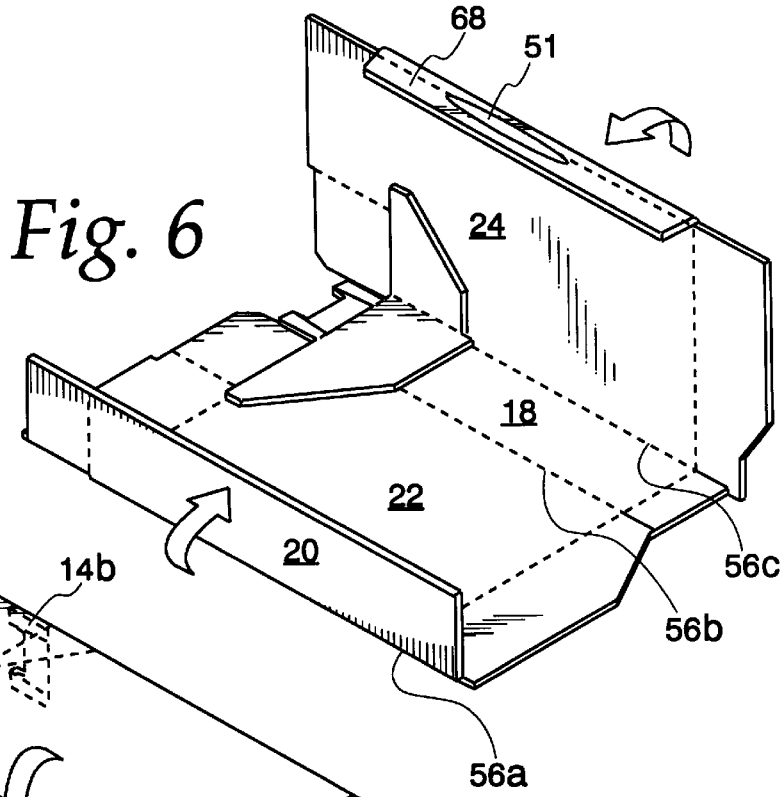
FIG. 6 is an isometric view of the first blank after one of the side walls and the back wall have been folded inward.
Figure 7:
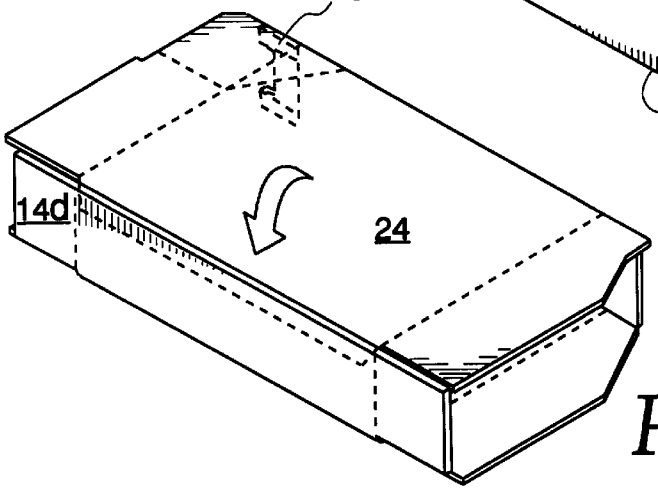
FIG. 7 is an isometric view of the first blank after the glue flap has been attached to the back wall.

To realize the further folded blank in FIG. 7 from the partially folded blank in FIG. 5, 90 degree folds are successively imparted to the blank along the working fold lines 56*a–d.* First, the glue flap 68 is folded inward approximately 90 degrees relative to the second carton side wall 24 along the working fold line 56*d,* as shown in FIG. 5. Second, the carton side wall 24 is folded inward approximately 90 degrees relative to the carton front wall 18 along the working fold line 56*c,* as shown in FIG. 6. Third, the carton back wall 20 is folded inward approximately 90 degrees relative to the carton side wall 22 along the working fold line 56*a,* as shown in FIG. 6. Fourth, the carton front wall 18 is folded inward approximately 90 degrees relative to the first carton side wall 22 along the working fold line 56*b,* as shown in FIG. 7. As a result of the above folds, the inner surface of a strip section 20*a* along the free edge of the first side wall 20 is adjacent to the outer surface of a glue flap 68 hingedly connected to the carton side wall 24. Strip section 20*a* is adhered to the outer surface of the glue flap 68.

Figure 8:
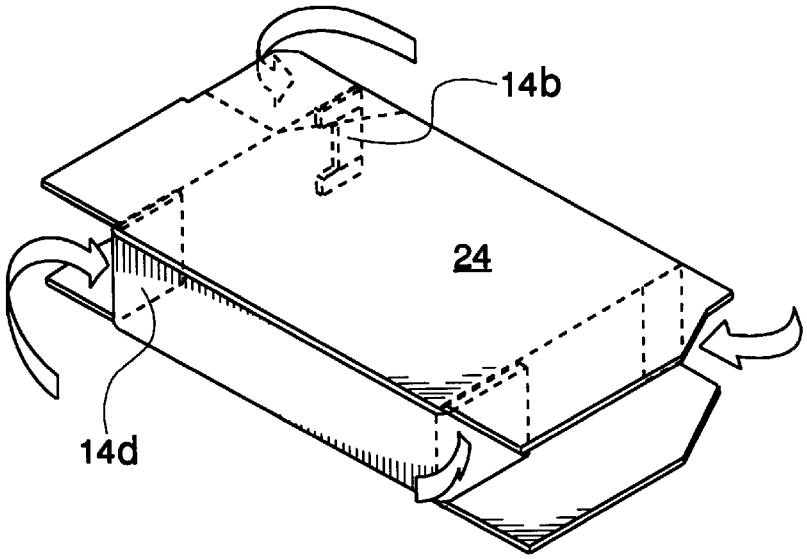
FIG. 8 is an isometric view of the first blank after the top and bottom minor flaps have been folded inward.
Figure 9:
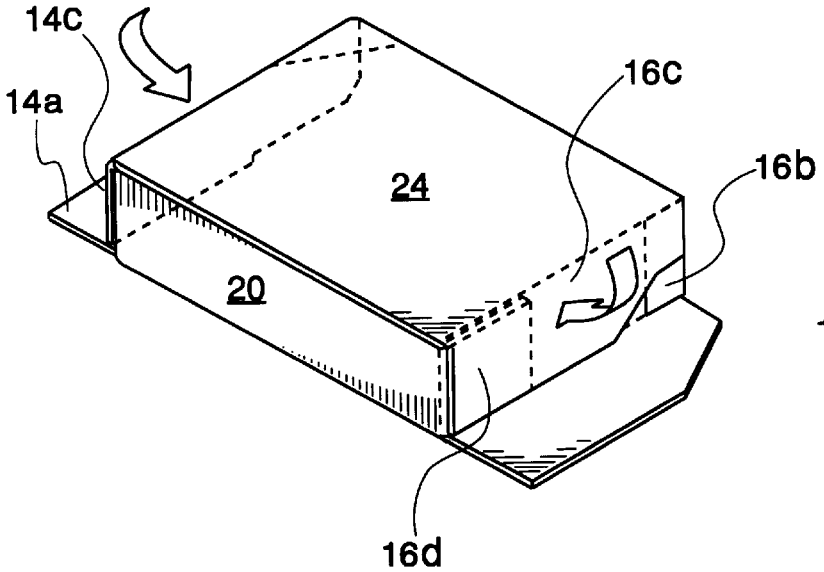
FIG. 9 is an isometric view of the first blank after one of the top and bottom major flaps has been folded inward.
Figure 10:
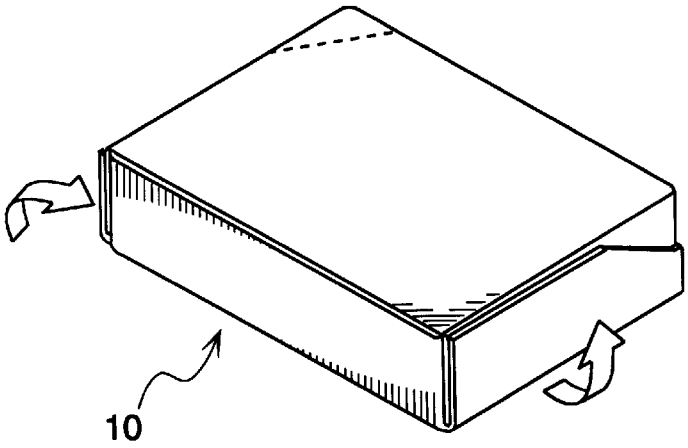
FIG. 10 is an isometric view of the first blank after the other of the top and bottom major flaps has been folded inward.

FIGS. 8–10 illustrate how the top and bottom closure flaps are folded and glued in a conventional fashion to form the top and bottom walls 14 and 16. To form the top wall 14, the top minor flaps 14*b* and 14*d* are first folded inward approximately 90 degrees relative to the respective front and back walls 18 and 20. To form the bottom wall 16, the bottom minor flaps 16*b* and 16*d* are then folded inward approximately 90 degrees relative to the respective front and back walls 18 and 20. The top major flaps 14*a* and 14*c* and the bottom major flaps 16*a* and 16*c* are then successively folded inward approximately 90 degrees relative to the respective first and second walls 22 and 24. The inner surface of the top major flap 14*a* is adhered to the underlying outer surface of the top major flap 14*c*. The inner surface of the top major flap 14*c* may also be adhered to the underlying outer surfaces of the top minor flaps 14*b* and 14*d*. Likewise, the inner surface of the bottom major flap 16*a* is adhered to the underlying outer surface of the bottom major flap 16*c*. The inner surface of the bottom major flap 16*c* may also be adhered to the underlying outer surfaces of the bottom minor flaps 16*b* and 16*d*. The sealed container 10 resulting from the formation of the top and bottom walls 14 and 16 is depicted in FIG. 10.

The flip-top construction of the sealed container 10 is illustrated in FIGS. 11–13. The sealed container 10 may be opened as shown in FIGS. 12 and 13 by first inserting one's thumb in the thumb-hole 63 (see FIG. 1) and then lifting the lid 28 upwardly away from the top of front wall 18 thereby tearing the preferential area of weakness 26.

FIGS. 14–17 depict a second embodiment of the present invention. A flip-top reclosable container is formed from a unitary, continuous blank 80 having a carton-forming portion 11 and a collar-forming portion 82. As much of the blank 80 is identical to the blank 50 in FIG. 3, the description below focuses on those portions of the blank 80 that are different from the blank 50.

Figure 18:
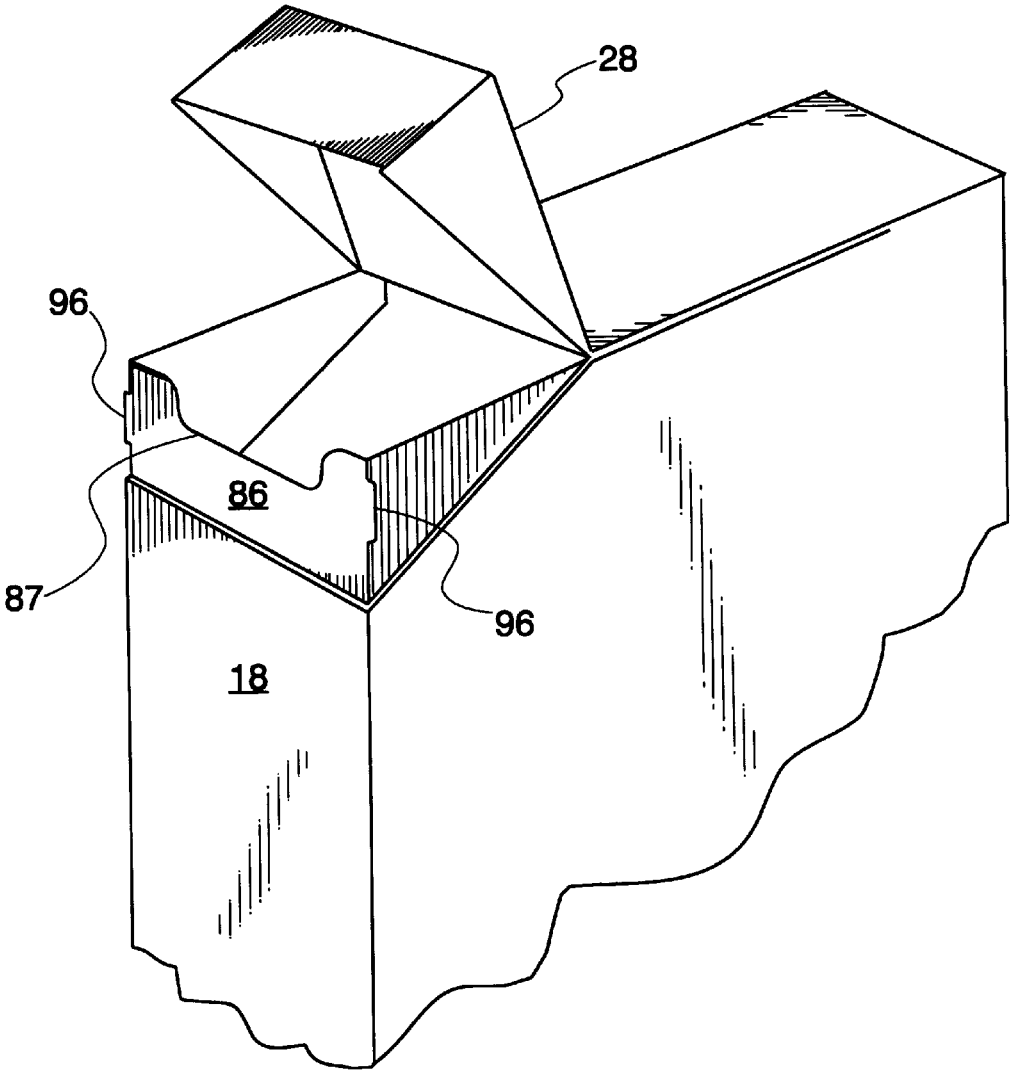
FIG. 18 is an isometric view of another closure feature of the present invention where the container is in the opened position.
Figure 19:
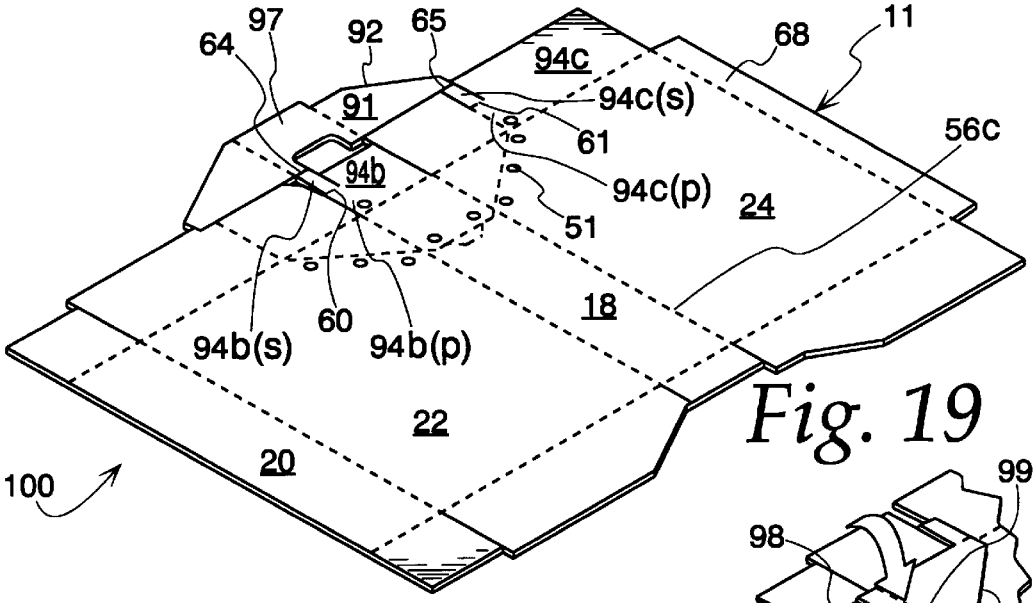
FIG. 19 is an isometric view of a third blank used to form the container of the present invention.

In its sealed form, the flip-top reclosable container formed from the blank 80 and the sealed container 10 in FIG. 1 would appear very similar; however, the construction of the front closure feature differs between the two containers. As stated above, the front snap closure feature of the container 10 is formed by the extension flap 62 hingedly connected to the internal collar front panel 36. This extension flap 62 creates the hinged and island portions 42 and 44. In contrast, the front closure feature of the flip-top reclosable container formed from blank 80 is constructed with an internal collar 82 having protruding die-cut portions 96 which, after the internal collar 82 is folded, extend outward from a front panel 86 of the internal collar 82 in a plane generally parallel to the front panel 86 so as to allow for increased frictional engagement with the lid 28, as shown in FIG. 18.

Furthermore, the container formed from the blank 80 is capable of holding a pourable non-liquid product, such as cereal, flakes, granules, chips, crackers, cookies, nuts, pretzels, etc. Therefore, the container of the present invention is designed with the front panel 86 including a generally rectangular cut-out spout 87 for directing the flow of any such product out of the container.

Figure 15:
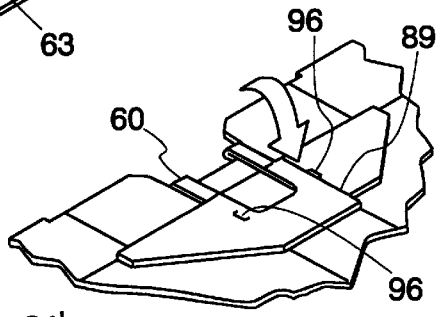
FIG. 15 is a partial isometric view of the second blank after the internal collar has been folded inward.
Figure 16:
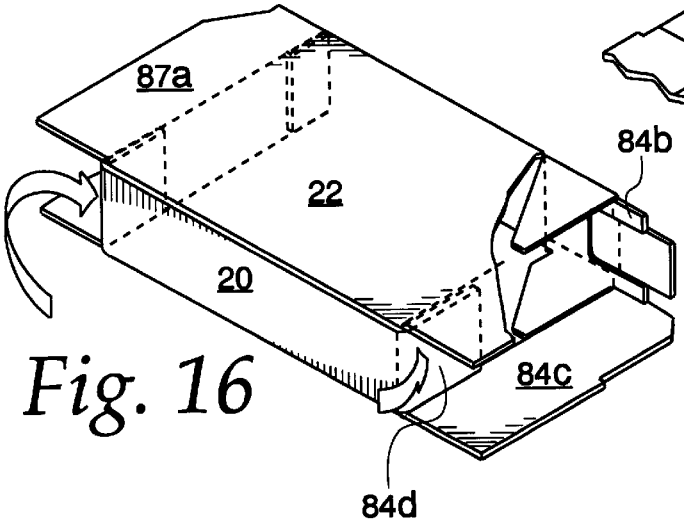
FIG. 16 is an isometric view of the second blank after the bottom minor flaps and one of the top minor flaps have been folded inward.
Figure 17:
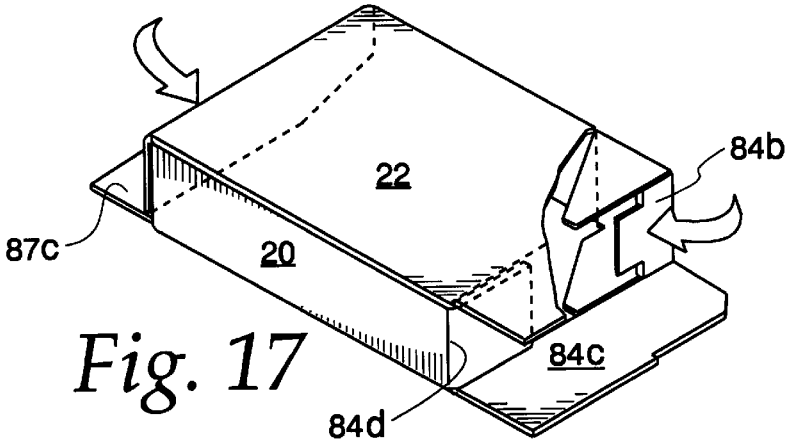
FIG. 17 is an isometric view of the second blank after one of the bottom major flaps and the other of the top minor flaps have been folded inward.

FIGS. 15–17 depict the folding sequence of the second embodiment of the present invention. To realize the partially folded blank in FIG. 15 from the unfolded blank 80 in FIG. 14, the collar-forming portion 82 is folded along the working fold line 60. Specifically, the internal collar 82 is folded inward approximately 180 degrees relative to the front wall 18 along the working fold line 60. In particular, the secondary minor flap portions 14*b*(s) are folded inward approximately 180 degrees relative to the primary minor flap portion 14*b*(p) along the working fold line 60, as shown in FIG. 15. As a result of the above fold, the inner surfaces of the secondary minor flap portions 14*b*(s) are adjacent to the inner surface of the primary minor flap portion 14*b*(p) and the inner surface of the internal collar 82 is adjacent to the inner surface of the front wall 18, the first side wall 22 and the second side wall 24. The inner surfaces of the secondary minor flap portions 14*b*(s) are adhered to the inner surface of the primary minor flap portion 14*b*(p) and the inner surface of the internal collar 82 is then adhered to the inner surface of the front wall 18, the first side wall 22 and the second side wall 24. As a result of the above folds, the internal collar 82 is at a slight angle relative to the top of the front wall 18. Specifically, fold line 89 is displaced over or to the right of fold line 56*c*. In this way, because cold glue is used, when the second side wall 24 is folded inward with respect to the front wall 18, the in terminal collar 82 is moved into proper alignment with the front panel 18 and the side panels 22 and 24.

The remaining steps for folding the partially folded blank 80 in FIG. 15 are the same as described above in connection with FIGS. 4–10. These steps are illustrated in FIG. 16 (minor flaps folded inward) and FIG. 17 (front minor flap and one bottom major flap folded inward).

FIGS. 19–22 depict a third embodiment of the present invention. A flip-top reclosable container is formed from a unitary, continuous blank 100 having a carton-forming portion 11 and a collar-forming portion 92. As much of the blank 100 is identical to the blank 50 in FIG. 3, the description below focuses on those portions of the blank 100 that are different from the blank 50.

The collar-forming portion 92 of the blank 100 includes a front top minor flap 94*b* with only one secondary portion 94*b*(s). A second secondary portion 94*c*(s) is formed from a second top major flap 94*c*. In order to allow the lid of the resulting container to open, the front panel 97 of the collar-forming portion 92 is detachably connected to the secondary portion 94*b*(s) along horizontal fold line 64. The second side panel 91 of the collar-forming portion 92 is hingedly connected to the secondary portion 94*c*(s) of the second top major flap 94*c* along horizontal fold line 65 because the second secondary portion 94*c*(s) need not be detached from the second primary portion 94*c*(p) to allow the lid to open.

Furthermore, the container formed by the blank 100 is capable of holding a pourable non-liquid product, such as cereal, flakes, granules, chips, crackers, cookies, nuts, pretzels, etc. Therefore, the container of the present invention is designed with the front panel 97 including a generally rectangular cut-out spout 98 for directing the flow of any such product out of the container.

Figure 20:
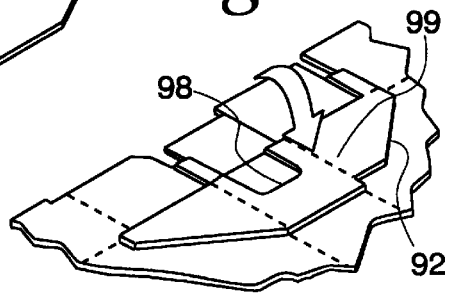
FIG. 20 is a partial isometric view of the third blank after the internal collar has been folded inward.
Figure 21:
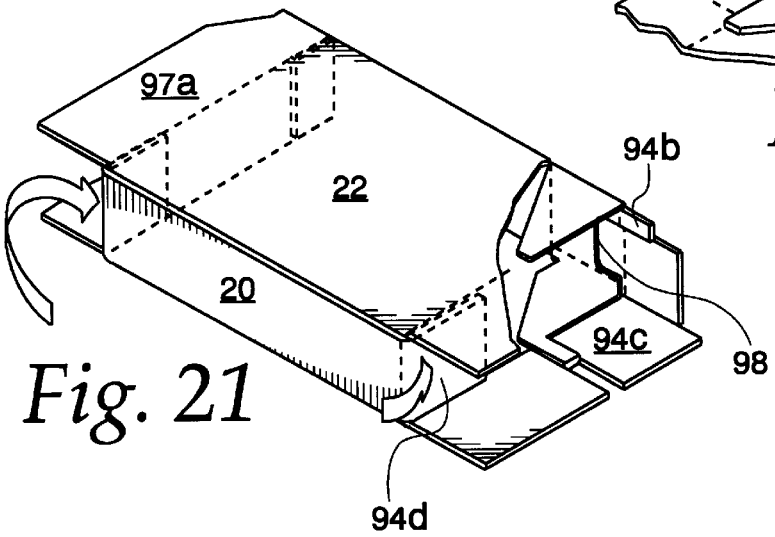
FIG. 21 is an isometric view of the third blank after the bottom minor flaps and one of the top minor flaps have been folded inward.
Figure 22:
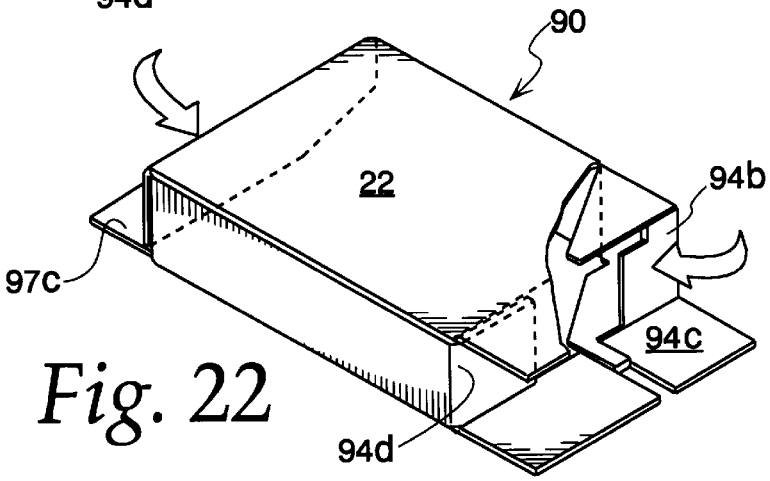
FIG. 22 is an isometric view of the third blank after one of the bottom major flaps and the other of the top minor flaps have been folded inward.

FIGS. 20–22 depict the folding sequence of the third embodiment of the present invention. To realize the partially folded blank in FIG. 20 from the unfolded blank 100 in FIG. 19, the collar-forming portion 92 is folded along working fold lines 60 and 61. Specifically, the secondary portion 94*b*(s) is folded inward approximately 180 degrees relative to the front top minor flap 94*b* along the working fold line 60. The secondary portion 94*c*(s) is folded inward approximately 180 degrees relative to the second top major flap 94*c* along the working fold line 61.

As a result of the above fold, the inner surface of the secondary minor flap portion 94*b*(s) is adjacent to the inner surface of the primary minor flap portion 94*b*(p). The inner surface of the secondary major flap portion 94*c*(s) is adjacent to the inner surface of the primary major flap portion 94*c*(p). The inner surface of the internal collar 92 is adjacent to the inner surface of the respective front wall 18, the first side wall 22 and the second side wall 24. The inner surface of the secondary minor flap portion 94*b*(s) is then adhered to the inner surface of the primary minor flap portion 94*b*(p). The inner surface of the secondary major flap portion 94*c*(s) is then adhered to the inner surface of the primary major flap portion 94*c*(p). The inner surface of the internal collar 92 is then adhered to the inner surface of the front wall 18, the first side wall 22 and the second side wall 24. As a result of the above folds, the internal collar 92 is at a slight angle relative to the top of the front wall 18. Specifically, fold line 99 is displaced over or to the right of fold line 56*c*. In this way, because cold glue is used, when the second side wall 24 is folded inward with respect to the front wall 18, the internal collar 92 is moved into proper alignment with the front panel 18 and the side panels 22 and 24.

The remaining steps for folding the partially folded blank 100 in FIG. 20 are the same as described above in connection with FIGS. 4–10. These steps are illustrated in FIG. 21 (minor flaps folded inward) and FIG. 22 (front minor flap and one bottom major flap folded inward).

The one-piece, flip-top reclosable containers described above in connection with FIGS. 1–22 are advantageous because they can be produced from less paperboard than typical two-piece, flip-top reclosable containers. Even though the collar-forming portion of each blank protrudes outside of the generally rectangular outline of the carton-forming portion (see FIGS. 3, 14 and 19), the collar-forming portion of the blank is nested into the bottom of a carton-forming portion of an adjacent blank during the manufacturing process. Thus, the present blank configuration minimizes the amount of paperboard used, thereby reducing the manufacturing costs of the container while saving paperboard.

In addition, the containers described above in connection with FIGS. 1–22 are advantageous because the hinged connection of the internal collar and the outer carton assures that the internal collar is properly aligned with the outer carton. For example, as shown in FIG. 3, the front panel 36 of the collar-forming portion 12 of the blank 50 is hingedly connected to the secondary portions 14*b*(s) of the top minor flap 14*b* of the carton-forming portion 11 along the horizontal fold lines 64. Thus, since the collar-forming portion 12 is hingedly connected to the carton-forming portion 11, these two elements are properly aligned with each other after the second side wall 24 is folded inward 90 degrees relative to the front wall 18 in the manufacturing process (see FIG. 6). Specifically, the vertical fold line 56*c* of the carton-forming portion 11 is aligned with the corresponding vertical fold line 58 of the collar-forming portion 12. This proper alignment assures that the fold lines 56*a–d* will not crack in response to forming the blank into the reclosable container. Moreover, the proper alignment of the outer carton and the internal collar assures that the snap closure feature will function properly.

Additionally, the container 10 of the present invention includes a top wall 14 that only partially opens such that a spout is formed by the first and second side panels 38 and 40 and the front panel 36 of the internal collar 12. The container design of the present invention forms a spout for directing a pourable non-liquid product out of the container 10 after the top wall 14 has been partially opened. Moreover, the design of the present invention allows for variations in the design of FIGS. 1–13 which include:

producing an internal collar having die-cut portions that, after the internal collar is folded, extend outward from the collar front panel in a plane generally parallel to the collar front panel so as to allow for increased frictional engagement with the lid of the container; and producing a carton having its internal collar attached to the carton-forming portion by two secondary portions formed from adjoining top major and minor flaps.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A flip-top reclosable container comprising:

an outer carton including opposing top and bottom walls, opposing front and back walls, and opposing first and second side walls, said first and second side walls and said front wall including a preferential area of weakness for opening said carton from a sealed form to an unsealed form, said preferential area of weakness forming a lid hingedly connected to said top wall, said top wall including a front top minor flap hingedly connected to an upper end of said front wall; and an internal collar integrally formed with said front top minor flap, said internal collar disposed within said carton when said carton is in said sealed form, said internal collar including a front panel and opposing first and second side panels adjacent to said respective front wall and said opposing first and second side walls of said carton, said internal collar including an extension flap comprising at least one hinged portion and at least one island portion disposed in forcibly displaceable mutual engagement such that opening said lid exerts a force which disengages said mutual engagement and closing said lid leads to snap re-engagement of said hinged portion and said island portion.

2. The container of claim 1, wherein said front wall of said container includes a thumb-hole for opening said container, said thumb-hole being located in an area of said front wall overlapped by said internal collar.

3. The container of claim 1, wherein said island portion is fixedly attached to an inner front surface of said lid and at the same time separatably attached to said hinged portion, wherein opening said lid separates said island portion from said hinged portion while retaining said island portion on said lid.

4. The container of claim 1, wherein said front panel and said first and second side panels of said internal collar are adhered to inner surfaces of said respective front wall and said first and second side walls of said carton at locations below said preferential area of weakness.

5. The container of claim 1, wherein said container has a width and a length, said length being substantially greater than said width, said front and back walls defining said width and said first and second side walls defining said length.

6. The container of claim 5, wherein said front panel and said first and second side panels of said internal collar are adhered to said front wall, and said first and second side walls, respectively, and wherein said container is capable of holding a pourable non-liquid product, said internal collar forming a spout for directing any such product out of said container.

7. The container of claim 6, wherein said product is selected from the group consisting of cereal, flakes, granules, chips, crackers, cookies, nuts, and pretzels.

8. The container of claim 1, wherein said preferential area of weakness is selected from the group consisting of a perforated line and a reverse cut.

9. A flip-top reclosable container comprising:

an outer carton including opposing top and bottom walls, opposing front and back walls, and opposing first and second side walls, said first and second side walls and said front wall including a preferential area of weakness for opening said carton from a sealed form to an unsealed form, said preferential area of weakness forming a lid hingedly connected to said top wall, said top wall including a front top minor flap hingedly connected to an upper end of said front wall, said front top minor flap including a primary portion and two secondary portions extending therefrom, said secondary portions overlapping and being adhered to said primary portion, said internal collar being detachably connected to said secondary portions of said front top minor flap; and an internal collar integrally formed with said front top minor flap, said internal collar disposed within said carton when said carton is in said sealed form, said internal collar including a front panel and opposing first and second side panels adjacent to said respective front wall and said opposing first and second side walls of said carton.

10. The container of claim 9, wherein said container is capable of holding a pourable non-liquid product and said front panel and said first and second side panels of said internal collar form a spout for directing any such product out of said container.

11. The container of claim 9, wherein said front panel of said internal collar is detachably connected to said front top minor flap prior to initially opening said lid.

12. The container of claim 9, wherein said internal collar has die-cut portions extending outward from said front panel in a plane generally parallel to said front panel.

13. A flip-top reclosable container comprising:

an outer carton including opposing top and bottom walls, opposing front and back walls, and opposing first and second side walls, said first and second side walls and said front wall including a preferential area of weakness for opening said carton from a sealed form to an unsealed form, said preferential area of weakness forming a lid hingedly connected to said top wall, said top wall including a front top minor flap hingedly connected to an upper end of said front wall; and an internal collar integrally formed with said front top minor flap, said internal collar disposed within said carton when said carton is in said sealed form, said internal collar including a front panel and opposing first and second side panels adjacent to said respective front wall and said opposing first and second side walls of said carton said internal collar being hingedly connected to said front top minor flap prior to initially opening said lid, and wherein opening said lid breaks said hinged connection between said internal collar and said front top minor flap.

14. The container of claim 13, wherein said internal collar has die-cut portions extending outward from said front panel in a plane generally parallel to said front panel.

15. The container of claim 13, wherein said lid is hingedly connected to said top wall along a hinge that is spaced away from said back wall.

16. The container of claim 13, wherein said second side wall includes a top major flap, said front top minor flap including a first primary portion and a first secondary portion, said top major flap including a second primary portion and a second secondary portion, said first secondary portion being hingedly connected to said first primary portion, said second secondary portion being hingedly connected to said second primary portion.

17. The container of claim 16, wherein said first and second secondary portions overlap and are adhered to said respective first and second primary portions.

18. The container of claim 13, wherein said container is capable of holding a pourable non-liquid product and said front panel of said internal collar has a generally rectangular cut-out spout for directing the flow of any such product out of said container.

19. A method of manufacturing a flip-top reclosable container, comprising the steps of:

providing a blank including a carton-forming portion and a collar-forming portion, said carton-forming portion having front and back walls and first and second side walls hingedly connected to each other along a plurality of first vertical fold lines, said carton-forming portion including a plurality of top and bottom closure flaps hingedly connected to respective upper and lower ends of said walls, said top closure flaps including a front top minor flap, said front top minor flap including a primary portion and first and second secondary portions, said primary portion being hingedly connected to said upper end of said front wall, said first and second secondary portions being hingedly connected to said primary portion and detachably connected to said collar-forming portion, said collar-forming portion including a front panel and first and second side panels hingedly connected to each other along a plurality of second vertical fold lines, said front panel being detachably connected to said front top minor flap along at least one horizontal fold line;

folding said blank so that said collar front panel and said opposing first and second collar side panels are adjacent to said respective front wall and said opposing first and second side walls;

adhering said collar front panel and said opposing first and second collar side panels to said respective front wall and said opposing first and second side walls; and forming said blank into said reclosable container, said container including an outer carton formed from said carton-forming portion and an internal collar formed from said collar-forming portion.

20. The method of claim 19, wherein said collar-forming portion includes at least one hinged portion and at least one island portion disposed in forcibly displaceable mutual engagement.

21. The method of claim 20, wherein said collar-forming portion includes an extension flap hingedly connected to said collar front panel, said extension flap forming said island portion and said hinged portion.

22. The method of claim 20, wherein said forcibly displaceable mutual engagement is such that opening said lid exerts a force which disengages said mutual engagement and closing said lid leads to snap re-engagement of said hinged portion and said island portion.

23. The method of claim 19, wherein said collar-forming portion is detachably connected to said secondary portions of said front top minor flap.

24. The method of claim 19, further including the steps of folding said secondary portions of said front top minor flap relative to said primary portion such that said secondary portions overlap said primary portion and adhering said secondary portions to said primary portion.

25. The method of claim 19, wherein said collar-forming portion has die-cut portions extending outward from said front panel in a plane generally parallel to said front panel.

26. The method of claim 19, wherein said container is capable of holding a pourable non-liquid product and said front panel of said internal collar has a generally rectangular cut-out spout for directing the flow of any such product out of said container.

27. A flip-top reclosable container comprising:

an outer carton including opposing top and bottom walls, opposing front and back walls, and opposing first and second side walls, said first and second side walls and said front wall including a preferential area of weakness for opening said carton from a sealed form to an unsealed form, said preferential area of weakness forming a lid hingedly connected to said top wall, said top wall including minor flaps hingedly connected to upper ends of said front and back walls, said top wall including major flaps hingedly connected to upper ends of said first and second side walls; and an internal collar integrally formed with one of said minor flaps, said internal collar disposed within said carton when said carton is in said sealed form, said internal collar including a front panel and opposing first and second side panels adjacent to said respective front wall and said opposing first and second side walls of said carton, said internal collar including an extension flap comprising at least one hinged portion and at least one island portion disposed in forcibly displaceable mutual engagement such that opening said lid exerts a force which disengages said mutual engagement and closing said lid leads to snap re-engagement of said hinged portion and said island portion.

28. The container of claim 27, wherein said container has a width and a length, said length being substantially greater than said width, said front and back walls defining said width and said first and second side walls defining said length.

29. The container of claim 28, wherein said lid is hingedly connected to said top wall along a hinge that is spaced away from said back wall.

30. The container of claim 28, wherein said front panel and said first and second side panels of said internal collar are adhered to said front wall, and said first and second side walls, respectively, and wherein said container is capable of holding a pourable non-liquid product, said internal collar forming a spout for directing any such product out of said container.

31. The container of claim 30, wherein said product is selected from the group consisting of cereal, flakes, granules, chips, crackers, cookies, nuts, and pretzels.

32. The container of claim 27, wherein said preferential area of weakness is selected from the group consisting of a perforated line and a reverse cut.

33. The container of claim 27, wherein said internal collar is also integrally formed with one of said major flaps.

34. The container of claim 27, wherein said front wall of said container includes a thumb-hole for opening said container, said thumb-hole being located in an area of said front wall overlapped by said internal collar.

35. The container of claim 27, wherein said island portion is fixedly attached to an inner surface of said lid and at the same time separatably attached to said hinged portion, wherein opening said lid separates said island portion from said hinged portion while retaining said island portion on said lid.

36. The container of claim 27, wherein said front panel and said first and second side panels of said internal collar are adhered to inner surfaces of said respective front wall and said first and second side walls of said carton at locations below said preferential area of weakness.

37. The container of claim 27, wherein said container is capable of holding a pourable non-liquid product and said front panel and said first and second side panels of said internal collar form a spout for directing any such product out of said container.

* * * * *